US008091608B2

(12) United States Patent
Walker et al.

(10) Patent No.: US 8,091,608 B2
(45) Date of Patent: Jan. 10, 2012

(54) METHOD OF FORMING A HOLLOW SAND CORE

(75) Inventors: Michael J. Walker, Windsor (CA); Thomas C. Pederson, Rochester Hills, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 370 days.

(21) Appl. No.: 12/466,535

(22) Filed: May 15, 2009

(65) Prior Publication Data

US 2010/0288460 A1 Nov. 18, 2010

(51) Int. Cl.
*B22C 9/10* (2006.01)

(52) U.S. Cl. ..... 164/28; 164/35; 164/44; 164/45

(58) Field of Classification Search ..... 164/28, 164/35, 44, 45

See application file for complete search history.

(56) References Cited

U.S. PATENT DOCUMENTS

| | | | | |
|---|---|---|---|---|
| 3,989,089 | A | 11/1976 | Deguchi | |
| 4,232,726 | A | 11/1980 | Michelson | |
| 4,311,184 | A | 1/1982 | Michelson | |
| 4,390,056 | A | 6/1983 | Grove et al. | |
| 4,561,485 | A | 12/1985 | Uzaki et al. | |
| 4,628,983 | A | 12/1986 | Myers et al. | |
| 4,694,883 | A | 9/1987 | Haiduk | |
| 5,479,981 | A | 1/1996 | Kim | |
| 5,769,150 | A | 6/1998 | Fukuda | |
| 5,915,451 | A | 6/1999 | Nakamura | |
| 2006/0065383 | A1 * | 3/2006 | Ortiz et al. | 164/4.1 |
| 2008/0105401 | A1 | 5/2008 | Nakai et al. | |

FOREIGN PATENT DOCUMENTS

JP 04071752 A * 3/1992

OTHER PUBLICATIONS

Efunda Engineering Fundamentals, Introduction to Sand Casting, Website: http://www.efunda.com/processes/metal_processing/sand_casting_intro.cfm; first accessed Sep. 4, 2008.

* cited by examiner

*Primary Examiner* — Jessica L Ward
*Assistant Examiner* — Kevin E Yoon
(74) *Attorney, Agent, or Firm* — Dierker & Associates, P.C.

(57) ABSTRACT

A method of forming a hollow sand core involves placing a preform into a cavity defined in a mold, where the preform has a predetermined configuration. A granular material is then introduced into the mold cavity and around the preform. The introduced granular material is established around the preform to form the hollow sand core. The preform is deformed in a manner sufficient to enable removal of the preform from inside the hollow sand core, and then is removed from the sand core. The removal of the preform exposes a hollow portion of the sand core.

13 Claims, 3 Drawing Sheets

METHOD OF FORMING A HOLLOW SAND CORE

TECHNICAL FIELD

The present disclosure relates generally to methods of forming sand cores and, more particularly, to a method of forming a hollow sand core.

BACKGROUND

Sand cores are often used to manufacture parts via casting processes. The sand core serves as a mold of the desired part shape. Sand cores may be made, for example, via cold box or no bake technologies. Such processes utilize organic and/or inorganic binders which adhere to the sand, thereby strengthening the resulting core. During both the cold box and no bake processes, a catalyst is used to harden the binders.

SUMMARY

A method of forming a hollow sand core involves placing a preform into a cavity defined in a mold, where the preform has a predetermined configuration. A granular material is then introduced into the mold cavity and around the preform. The introduced granular material is established around the preform to form the hollow sand core. The preform is deformed in a manner sufficient to enable removal of the preform from inside the hollow sand core, and then is removed from the sand core. The removal of the preform exposes a hollow portion of the sand core.

BRIEF DESCRIPTION OF THE DRAWINGS

Features and advantages the present disclosure will become apparent by reference to the following detailed description and drawings, in which like reference numerals correspond to similar, though perhaps not identical, components. For the sake of brevity, reference numerals or features having a previously described function may or may not be described in connection with other drawings in which they appear.

DETAILED DESCRIPTION

Examples of the method disclosed herein utilize a removable preform to form and shape the interior surface of a hollow sand core. This deformable preform advantageously enables the sand core to remain intact after formation and during preform removal. Furthermore, the hollow sand core formed using the preform may be desirable, as the amount of sand needed to form the core is reduced. It is further believed that the hollow portion of the sand core also enables gases generated during the casting process to be readily removed. The process disclosed herein is particularly advantageous in that typical processes, such as cold box and no bake technologies may be used to form the hollow sand core.

Figures 1A, 1B, 1C:
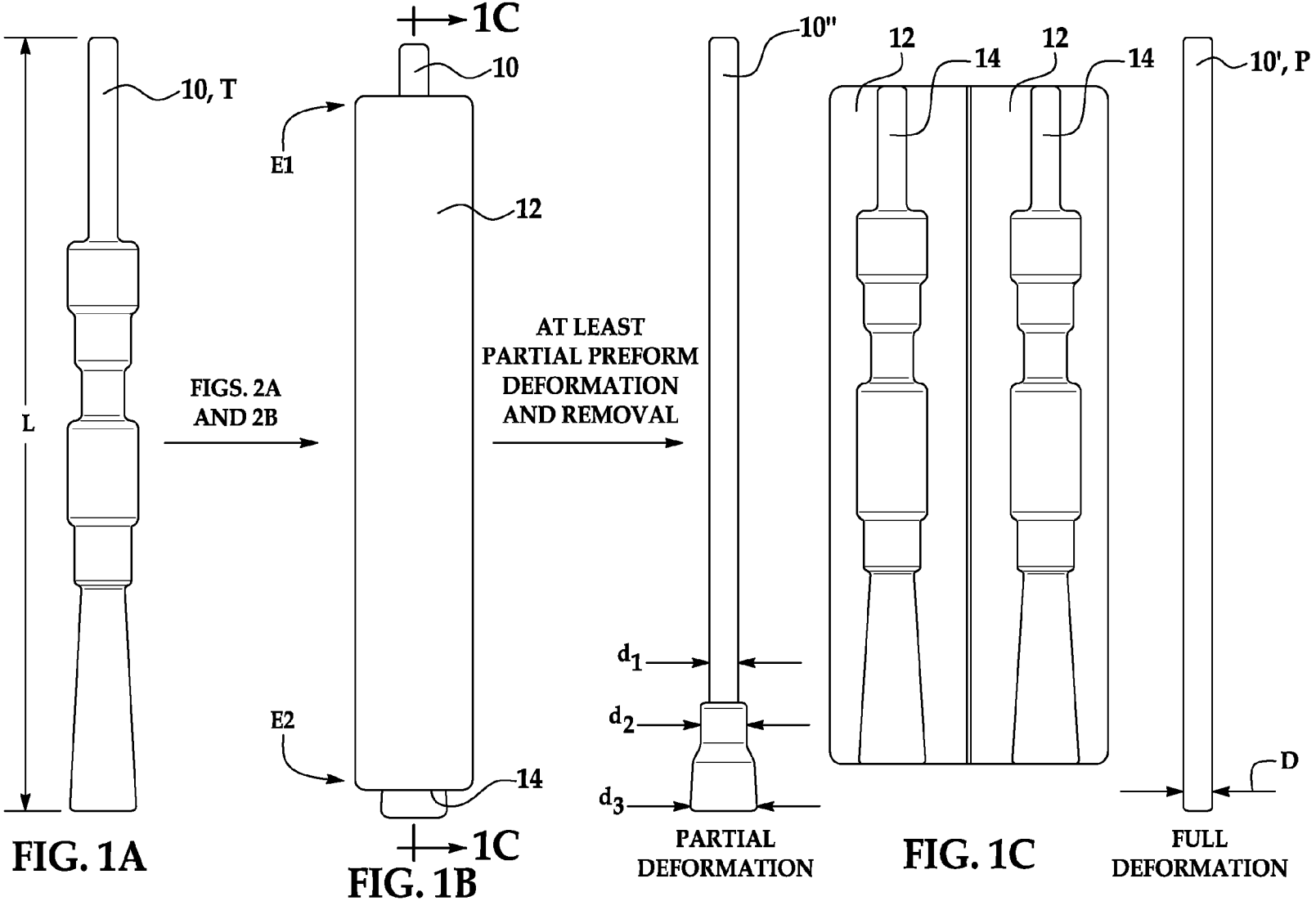
FIG. 1A is a semi-schematic top view of an embodiment of a preform prior to deformation.
FIG. 1B is a semi-schematic top view of an embodiment of a sand core having the non-deformed preform therein.
FIG. 1C is a semi-schematic top view of an embodiment of a preform both after partial deformation and after full deformation, and also a cross-sectional view of the sand core of FIG. 1B taken along the 1C-1C line.

Referring now to FIGS. 1A through 1C, depicted are embodiments of a preform 10 prior to sand core 12 formation (FIG. 1A), the preform 10 after sand core 12 formation and prior to removal (FIG. 1B), and both the fully deformed preform 10' and the partially deformed preform 10" after removal from the sand core 12 (FIG. 1C). It is to be understood that two preforms 10 are generally not used in formation of the sand core 12, but rather FIG. 1C is merely illustrating the types of deformation of the preform 10.

The preform 10, 10' is generally formed of a material that is capable of deforming from its temporary shape T (such as that shown in FIG. 1A) to a permanent shape P (e.g., the shape shown in FIG. 1C) that is generally smaller than the temporary shape T. By "generally smaller", it is meant that the preform 10' (shown in FIG. 1C) is removable from the sand core 12 via the hollow portion 14 at least one of the two ends E1, E2. As such, in the embodiments disclosed herein, the temporary shape T is the desirable shape of the inner core, and the shrunken, deformed shape is the permanent shape P. In one embodiment, the permanent shape P has the same overall shape as the temporary shape T, but has a smaller diameter than the temporary shape T. In another embodiment, the permanent shape P is an entirely different shape than the temporary shape T, and has a smaller diameter D than the temporary shape T.

It is to be understood that in some instances, the permanent shape P of the preform 10' is not completely obtained. This may be due to the fact that the entire preform 10 is not heated above the switching or glass transition temperature, or the non-deformed portion is placed onto a mandrel for introducing pressure inside the preform 10. A non-limiting example of this embodiment is shown as reference numeral 10" in FIG. 1C. It is to be understood that the permanent shape P is not completely obtained, and thus the diameter D is not consistent along the entire length L of the partially deformed preform 10". Partial deformation may be suitable as long as at least a portion of the diameter D is small enough along a portion of the length L such that the preform 10" is removable from the sand core 12. For example, the partially deformed preform 10" shown in FIG. 1C has multiple diameters $d_1$, $d_2$, $d_3$ While diameter $d_3$ is not smaller than that corresponding portion of the temporary shape T, the diameters $d_2$, $d_3$ enable the preform 10" to be removed from the sand core 12 by being pulled through the hollow end portion 14 at end E2.

While expansion and contraction of the preform 10 is shown in two directions (e.g., the diameter expands/contracts), it is to be understood that expansion/contraction may cause the preform 10 to change shape in three dimensions, similar to a balloon.

Non-limiting examples of suitable materials for the preform 10 include shape memory polymers (e.g., thermoplastics such as polyolefins, polyurethanes, polyacrylates, or thermosets, such as polyolefins that have been covalently cross-linked), or elastomeric materials (e.g., natural rubber, synthetic polyisoprene, butyl rubber, halogenated butyl rubbers (e.g., chloro butyl rubber, bromo butyl rubber, etc.), polybutadiene, styrene-butadiene rubber, nitrile rubber, hydrogenated nitrile rubber, chloroprene rubber, ethylene propylene rubber, epichlorohydrin rubber, polyacrylic rubber, silicone rubber, fluorosilicone rubber, fluoroelastomers, perfluoroelastomers, polyether block amides, chlorosulfonated polyethylene, ethylene-vinyl acetate, or thermoplastic elastomers). Some elastomeric materials are also shape memory materials.

Prior to being used to form the sand core 12, the preform 10 is shaped. The shaping process used will depend, at least in part, upon the material used. Very generally, the shaping technique is selected from blow molding, injection molding, compression molding, rotational molding, extrusion, stretching, or any combination of heating and force.

In one embodiment, the materials may be initially in the permanent shape P (e.g., via extrusion). The material may then be crosslinked using irradiation or a combination of heat and chemical means (depending upon the polymer used), blow molded above the glass transition temperature of the polymer, and then cooled to below the glass transition temperature to achieve the desirable temporary shape T.

In another embodiment, the materials may be initially in an expanded form that is even larger than the desirable temporary shape T. The material may be shrunk, via heating, to reduce the size of the material to a desirable temporary shape T.

When a shape memory polymer is used, the permanent shape P (i.e., the shrunken shape) may be set by bringing the material to a temperature that is at or above its melting temperature, forming it into the desirable shape P, and then cooling it below the glass transition temperature to set the shape P. If a thermoplastic shape memory polymer (with physical crosslinks) is used, then the permanent shape P may be reshaped by bringing the material again to a temperature that is at or above the melting temperature, reforming the shape, and cooling below the glass transition temperature. However, if the material used is a thermoset shape memory polymer (with covalent crosslinks), the permanent shape P may not be reprogrammed. Rather, this embodiment of the shape memory polymer preform 10, 10', 10" may be reused with the set permanent shape P.

In either case, to make the temporary shape T, the shape memory polymer is deformed above the glass transition temperature, molded into the desirable shape T, and cooled below the glass transition temperature. Heating the shape memory polymer above its glass transition/switching temperature causes the polymer to become pliable. Once pliable, a force (e.g., pressure, stretching, mechanical force, etc.) may, in some instances, be applied to expand the shape memory polymer into the desirable temporary shape T. An exterior mold may be used to achieve the desirable temporary shape T when the shape memory polymer is heated and becomes deformable. As mentioned above, once in the desirable shape, the polymer is cooled to set the temporary shape T.

Once the temporary shape T is set, if the shape memory polymer is again heated to above the glass transition temperature, it will revert back to the permanent shape P. As such, once the sand core 12 is formed (discussed further hereinbelow), the shape memory polymer is heated above its glass transition temperature again to recover the permanent deformed shape P. When the shape memory polymer is heated to a temperature above its glass transition temperature, the presence of physical or covalent crosslinks allows for the reversion of the shape memory polymer from one shape (e.g., the temporary shape T) to another shape (e.g., the permanent shape P) by releasing energy i) previously imparted to the system by the deformation of the polymer, and ii) stored in the system by subsequent cooling processes.

Figure 2B:
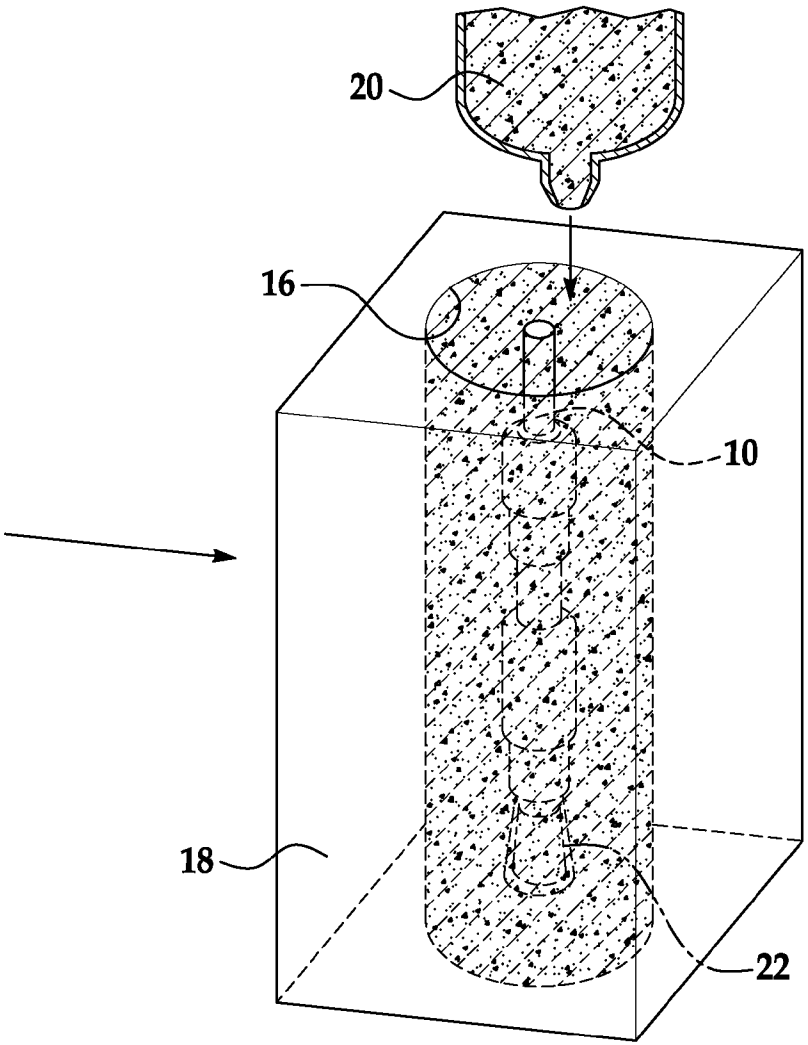
FIGS. 2A and 2B illustrate semi-schematic perspective views of a core box having the preform therein both before (FIG. 2A) and after (FIG. 2B) introduction of granular material and binder.
Figure 2A:
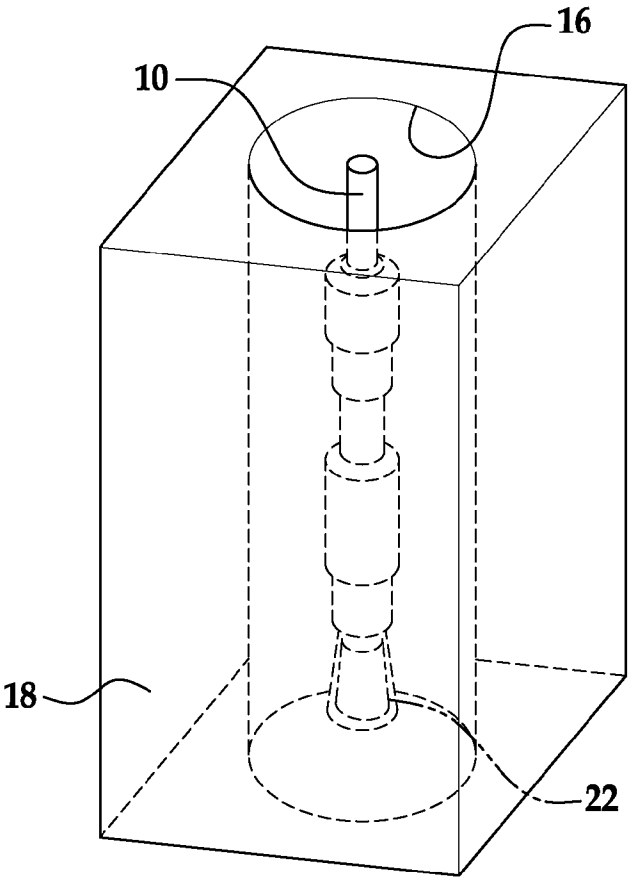

Referring now to FIG. 2A, when the desirable temporary shape T of the preform 10 is achieved, the preform 10 is positioned within a cavity 16 of a mold 18 (e.g., a core box). The preform 10 may be anchored within the cavity 16 on its own, or via mechanical means or via the application of pressure. If the preform 10 has sufficient rigidity to stand on its own in the cavity 16, no pressure would be required. The mold 18 may include one or more locating tabs 22 (shown in phantom) which protrude into the cavity 16 from a bottom surface of the mold 18. The locating tab(s) 22 are configured to support the preform 10. It is to be understood that both ends of the core box 18 may include locating tabs 22 to secure the preform 10 in the cavity 16. In such instances, the cavity 16 would be enclosed and the core box 18 would be opened/closed lengthwise (in the embodiment of FIGS. 2A and 2B, vertically) along a parting line. In instances in which the core box 18 has a vertical parting line, the locating tabs(s) 22 would be pulled out of, or otherwise removed from, the core box 18 before sand core 12 ejection/removal.

In other embodiments, a low amount of pressure (e.g., 1-5 psi) may be used to maintain the rigidity of the preform 10 during the core 12 generation process. In some embodiments, the preform 10 may be pressurized and sealed prior to the core 12 generation process. In other embodiments, the preform 10 may be pressurized while in the cavity 16. One end of the preform 10 may be configured to receive such pressure (e.g., via a port formed in the core box 18), and the pressure may be constantly supplied such it is maintained throughout core 12 formation or the preform 10 may be sealed once pressurized. In some cases when pressure is constantly supplied or the preform 10 is sealed to maintain rigidity, the core forming process may be repeated using the same preform 10 multiple times without its removal from the cavity 16. This may be accomplished because either the releasing of pressure and/or heating shrinks the preform 10 to its partially or fully deformed shape 10', 10" within the cavity 16, and the sand core 12 may be removed therefrom.

In still other embodiments (see FIG. 3), the mold 18 may have one or more holes 24 formed therein which receives the preform 10. The holes 24 are formed through a portion of the thickness T of the core box 18 walls such that each hole 24 respectively receives an opposed end of the preform 10. In such instances, the preform 10 is supported by the thickness T of the core box 18 at opposed ends. A plug or locating tab 22 (not shown in FIG. 3) may be inserted into the preform 10, thereby squeezing the preform 10 against the portion of the mold 18 which defines the hole 24 and providing rigidity to the preform 10. Such a plug or locating tab 22 would have a diameter just less than the diameter of the corresponding hole 24. In one embodiment, the plug or locating tab 22 may also have an aperture defined therein, which enables pressure to be applied to the preform 10 during core formation (e.g., if a suitable pressure port (not shown) is formed in the core box 18). In such instances, it may also be desirable to seal the other end of the preform 10 via another plug or locating tab 22 that does not include an aperture therein.

Figure 3:
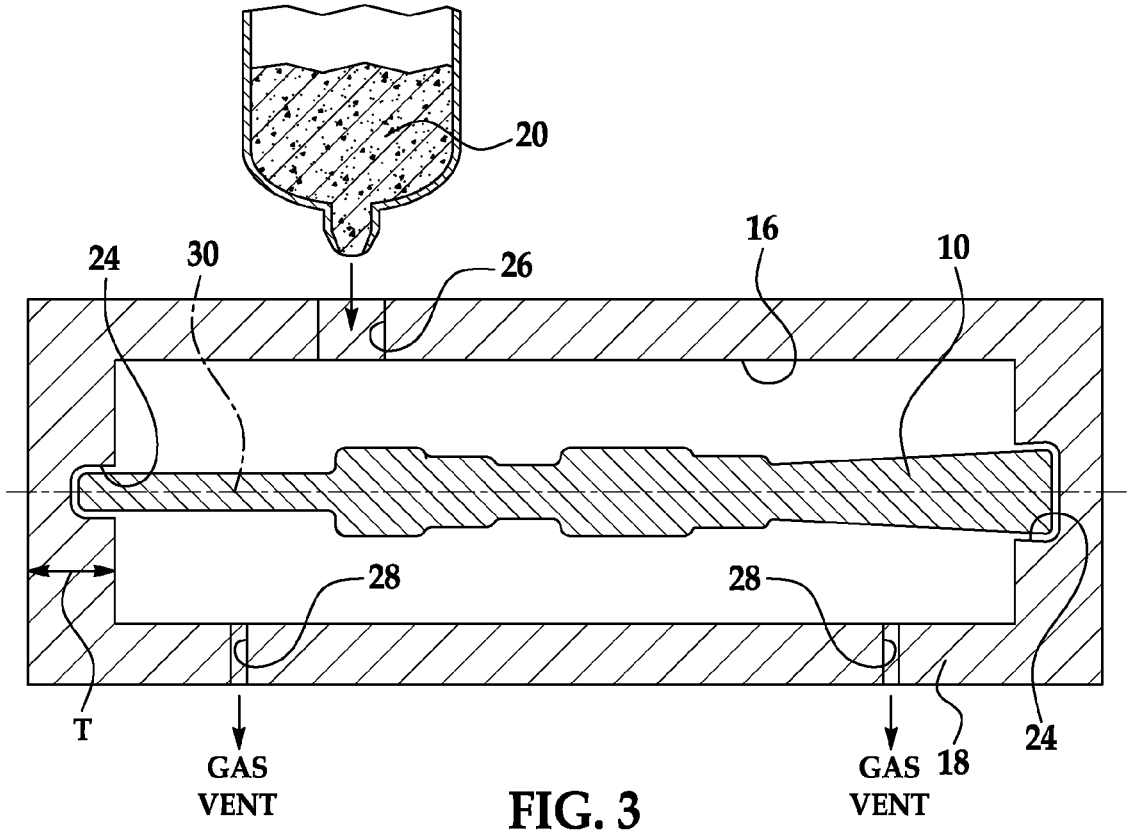
FIG. 3 is a schematic and partially cross-sectional view of a core box having the preform therein.

FIG. 3 also illustrates one blow tube 26 for the introduction of the sand 20 into the cavity 16, and vents for the release of air and/or other gas from the cavity 16. FIG. 3 also illustrates a horizontal parting line 30 for opening/closing the core box 18.

Referring back to FIG. 2B, a granular material 20 is introduced, under pressure or via gravity, into the mold cavity 16 and around the preform 10. In one embodiment, the granular material 20 is sand mixed with resin. This process is generally referred to as a cold box process. In this cold box process, the granular material 20 and resin is blown into the cavity 16 such that any space between the cavity 16 wall(s) and the exterior of the preform 10 is filled. A gaseous catalyst (e.g., triethylamine (also known as TEA gas) is used to initiate bonding of the sand and resin. In this embodiment, the catalyst is passed through the mold 18 such that it initiates curing of the resin and hardening of the materials to form the sand core 12. In another embodiment, the granular material 20 is sand mixed with resin and the catalyst. This process is generally referred to as a no bake process. In this no bake process, the sand/resin/catalyst mixture is rained into the cavity 16 such that any space between the cavity 16 wall(s) and the exterior of the preform 10 is filled. Ultimately, the catalyst initiates the bonding of the sand to the resin. In this embodiment, curing is accomplished within a specific time period. The resin ultimately cures and the bonded mixture hardens, thereby forming the sand core 12.

It is to be further understood that when pressure is utilized to support the preform 10 during core 12 formation, the pressure is released prior to any casting processes.

The formed sand core 12 still has the preform 10 therein, as shown in FIG. 1B. The sand core 12 may be used in subsequent casting processes to form parts. In some instances, it may be desirable to remove the preform 10 prior to the casting process, and in other instances, it may be desirable to remove the preform 10 after the casting process is complete. Generally, removing the preform 10 prior to casting is desirable. If the shape of the cast part and the preform 10 render the preform 10 readily removable after the part is formed, then preform 10 removal may be accomplished after part formation. When removed after casting in complete, such removal is often accomplished during the shake-out process.

Regardless of when preform 10 removal is desirable, such removal may be accomplished by deforming the preform 10 to its permanent shape P (i.e., deformed preform 10', shown in FIG. 1C) or its partially deformed shape 10" (also shown in FIG. 1C). Deformation may be accomplished by a variety of different methods. The method selected may depend, at least in part, upon the material used. In some instances, the casting process could heat the preform 10 sufficiently that it shrinks during such process. It is to be understood, however, that if the preform 10 removal is accomplished after casting, it may be removed without any shrinking, since the core 12 would be broken during the shakeout process.

In one embodiment, depressurization may be used to obtain the deformed (i.e., permanent shape P) preform 10' or partially deformed preform 10". This is generally used when pressure is used to maintain the temporary shape T during sand core 12 formation. The removal of pressure will cause the temporary shape T of the preform 10 to shrink to the permanent shape P. Once in the shrunken permanent shape P (or at least partially shrunken shape), the preform 10' (or preform 10") may be readily removed from one of the two ends E1, E2 through the hollow portion 14. This form of deformation is particularly suitable for the preform 10 formed of elastomeric materials.

In another embodiment, the preform 10 may be heated in order to initiate deformation. This technique may be used when a shape memory polymer preform 10 is utilized. Heating may be accomplished by introducing a fluid (e.g., gas (e.g., air, nitrogen, or any other gas that does not react with the sand core 12), liquid, etc.) having a temperature sufficient to deform or otherwise at least partially switch the state of the preform 10 into the smaller shaped preform 10' or preform 10". The fluid may be heated prior to being introduced or after being introduced into the preform.

It is to be understood that removal of the preform 10, 10', 10" will not deleteriously affect the shape of the sand core 12, at least in part because the core 12 has been cured and hardened prior to preform 10, 10', 10" removal.

Referring now to FIG. 1C, a cross-section of the sand core 12 taken along the 1C-1C line of FIG. 1B is depicted. The removed shrunken preform 10' and the partially shrunken preform 10" are also depicted. As shown, the interior of the sand core 12 includes the hollow portion 14 which has conformed to the temporary shape T of the preform 10. Since the preform 10 is shrunken to preform 10' or preform 10" prior to its removal, the sand core 12, and thus the hollow portion 14, remain set in the desirable shape.

Figures 4A, 4B:
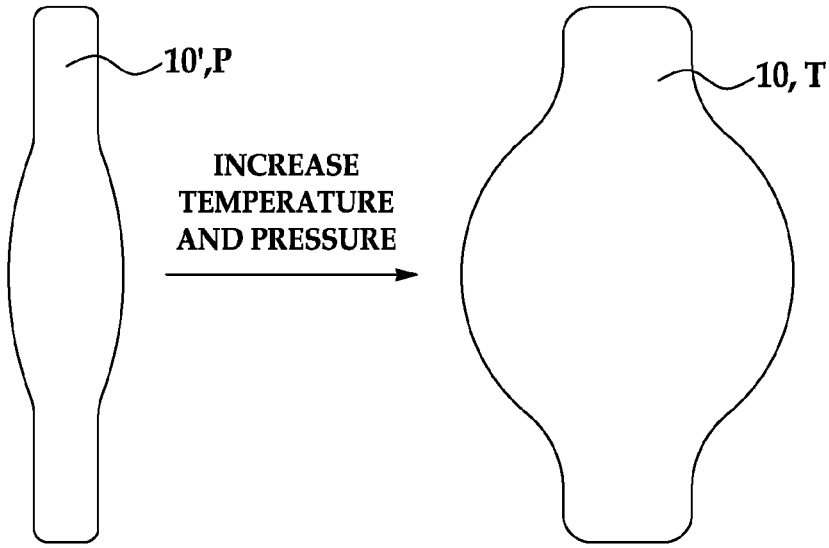
FIGS. 4A and 4B illustrate semi-schematic top views of another embodiment of a preform in its permanent shape (FIG. 4A) and its expanded temporary shape (FIG. 4B).

In another embodiment, the permanent shape P of the preform 10' is a smaller version of the desirable part shape, and the temporary shape T is an expanded version of the permanent shape P and is the desirable part shape. This is shown in FIGS. 4A and 4B. The application of temperature enables the preform 10' to become pliable, and the application of pressure causes the pliable preform to expand to the desired temporary shape T, 10. In this embodiment, the temperature is above the glass transition temperature of the material used for the preform 10, and the pressure is sufficient to expand the preform 10' to the desired temporary shape T. Heated gas may be used to raise the temperature and apply the pressure. Generally, the preform 10' expands proportionally to the pressure applied and the initial shape P.

This embodiment may be particularly suitable when the permanent shape P has different section thicknesses along the length (not shown). When pressure is applied above the glass transition temperature of the preform 10', the final temporary shape T will depend on, at least in part, the initial permanent shape P, the local material thickness, and the pressure applied.

The transition of the preform 10' to its temporary shape T may also be achieved by localized crosslinking. For example, in a material where the covalent cross linking is achieved by irradiation, the irradiation may be locally applied rather than to the entire preform 10'. For another example, where the cross linking is initiated by heat, heat may be selectively applied to local areas. Once cross linked, applying pressure above the glass transition temperature will result in different rates of expansion between the cross linked locations and the under cross linked locations.

It is believed that the embodiment shown in FIGS. 4A and 4B may be suitable for an automated process in which the preform 10 may be reused.

After the pressure is applied to achieve the desired temporary shape T, the pressure may be maintained, but the temperature changed such that it is decreased to below the glass transition temperature. This causes the temporary shape T to set so that the preform 10 becomes rigid in the core box cavity 16. The pressure may then be maintained or removed since the temporary shape 10, T is set to the desired core 12 inner shape.

In the embodiment shown in FIGS. 4A and 4B, the application of pressure may be accomplished by flowing a gas from one end of the preform 10, 10' to the other. If the preform 10, 10' were sealed at one end, two tubes may be used, one to introduce the gas therein and the other to remove the gas therefrom. In the latter embodiment, the difference in flow enables the pressure in the preform 10, 10' to be regulated.

While several embodiments have been described in detail, it will be apparent to those skilled in the art that the disclosed embodiments may be modified. Therefore, the foregoing description is to be considered exemplary rather than limiting.

The invention claimed is:

1. A method of forming a hollow sand core, comprising:

placing a preform into a cavity defined in a mold, the preform having a predetermined configuration;

introducing a granular material into the mold cavity and around the preform;

establishing the granular material around the preform to form a sand core;

deforming the preform in a manner sufficient to enable removal of the preform from inside the sand core; and removing the deformed preform from the sand core, thereby exposing a hollow portion of the sand core, wherein the preform is made from a shape memory polymer, and wherein prior to placing the preform into the cavity, the method further comprises:

setting a permanent shape of the shape memory polymer;

heating the shape memory polymer in its permanent shape to a temperature above its glass transition temperature, thereby rendering the shape memory polymer pliable;

shaping the pliable shape memory polymer into the predetermined configuration; and cooling the shape memory polymer to set the predetermined configuration and thus a temporary shape of the shape memory polymer.

2. The method as defined in claim 1 wherein the shaping is accomplished by at least one of stretching, pressurizing, molding, or applying a mechanical force to the shape memory polymer.

3. The method as defined in claim 1 wherein the introducing of the granular material is accomplished under pressure or by gravity.

4. The method as defined in claim 1 wherein after introducing the granular material into the mold cavity, the method further comprises bonding the granular material to form the sand core.

5. The method as defined in claim 4 wherein bonding the granular material is accomplished via a catalytic reaction.

6. The method as defined in claim 1 wherein the granular material is introduced into the mold cavity via blowing.

7. The method as defined in claim 1, wherein the predetermined configuration is a temporary shape of the shape memory material, and wherein a permanent shape of the shape memory material has a smaller diameter than the temporary shape.

8. The method as defined in claim 7 wherein the deforming of the preform is accomplished by introducing a heated fluid into the preform, the heated fluid having a temperature above a glass transition temperature of the preform.

9. The method as defined in claim 7 wherein the deforming of the preform is accomplished by:

introducing a fluid into the preform; and heating the fluid to a temperature above a glass transition temperature of the preform.

10. The method as defined in claim 9 wherein the fluid is a gas.

11. The method as defined in claim 1 wherein after establishing the granular material around the preform, the method further comprises curing the granular material.

12. The method as defined in claim 1 wherein the sand core is used for casting a part, and wherein the removing of the preform is accomplished i) prior to the casting, or ii) during a shake-out process after the casting.

13. The method as defined in claim 1 wherein the preform is a shape memory polymer, and wherein the shape memory polymer is selected from thermoplastic shape memory polymers and thermoset shape memory polymers.

* * * * *